US006353196B2

(12) United States Patent
Niinuma et al.

(10) Patent No.: US 6,353,196 B2
(45) Date of Patent: Mar. 5, 2002

(54) WATER-RESISTANT SWITCHING DEVICE

(75) Inventors: Akira Niinuma; Yoshifumi Okabe, both of Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/804,518

(22) Filed: Mar. 12, 2001

(30) Foreign Application Priority Data

Mar. 14, 2000 (JP) ..... 2000-076398

(51) Int. Cl.[7] ..... H01H 3/04
(52) U.S. Cl. ..... 200/335; 200/276
(58) Field of Search ..... 200/338, 335, 200/343, 276, 276.1

(56) References Cited

U.S. PATENT DOCUMENTS 4,488,018 A * 12/1984 Hayashida ..... 200/6 R
4,698,465 A * 10/1987 Oba ..... 200/16 F
5,376,764 A * 12/1994 Retter et al. ..... 200/245
5,913,415 A 6/1999 Kishi et al.

* cited by examiner

*Primary Examiner*—P. Austin Bradley
*Assistant Examiner*—Nhung Nguyen
(74) *Attorney, Agent, or Firm*—Brinks Hofer Gilson & Lione

(57) ABSTRACT

To provide a water-resistant pilot switch in which the shape of a shield member is simple, processibility of parts and workability in mounting the parts to a housing are good, cost cutting is possible, and the on precision of the switch in action can be improved. The water-resistant pilot switch comprises: a housing having a receiving section, a fixed contact provided in the receiving section, a movable contact rotatably provided and being brought into or out of contact with the fixed contact, a lever member rotating the movable contact in the direction of the fixed contact, a cover member having an insertion hole through which one end of the lever member protrudes outwardly from the receiving section and being provided on the receiving section of the housing to be engaged therewith, and a shield member shielding the insertion hole. The lever member is engaged with the insertion hole of the cover member in a rotatable manner, and the shield member is shaped like a ring to fit the rim of the insertion hole and is placed between the lever member and the cover member.

4 Claims, 5 Drawing Sheets

WATER-RESISTANT SWITCHING DEVICE

BACKGROUND OF THE INVENTION

1. Field of the Invention

The present invention relates to a water-resistant switching device. More particularly, it relates to construction of a water-resistant pilot switch in which contacts are switched by a rotary lever member.

2. Description of the Related Art

According to construction of a conventional water-resistant pilot switch, there are provided a fixed contact made up of a conductive metal plate, a movable contact which is disposed to oppose the fixed contact and is brought into or out of contact with the fixed contact, and a lever member rotating the movable contact in the direction of the fixed contact in a receiving section of a box-shaped housing made of an insulating material. Further, a cover member, which is also made of an insulating material is mounted so as to cover the receiving section of the housing.

An insertion hole through which an operating part, or one end portion of the lever member, protrudes outwardly from the housing is provided in the cover member, and the operating part is disposed in the insertion hole so as to be movable in the direction it is pressed.

Also, a shield member formed in the shape of a dome from a material such as a rubber sheet is attached to the insertion hole so as to cover the operating part of the lever member. By providing the shield member in the insertion hole, water and droplets are prevented from entering the receiving section of the housing through the insertion hole.

To actuate this conventional water-resistant pilot switch, the operating part is pressed from the above of the shield member by an actuator (control rod) rotatably mounted to one end portion of the housing so that the movable contact inside is rotated in the direction of the fixed contact by the lever member and the switch is turned on when the fixed contact and the movable contact come into contact with each other.

However, in the construction of the conventional water-resistant pilot switch described above, it was necessary to mount the shield member so as to cover the operating part. Therefore, the shield member had to be formed in accordance with the shape of the operating part, which made its shape complicated and mounting procedure troublesome. Thus, processibility of parts and workability of assembly were not good enough to achieve cost cutting.

Also, the conventional pilot switch is so constructed that the operating part of the lever member cannot be pressed directly, and it has to be pressed via the shield member made of elastic rubber or the like. Accordingly, there has been a problem that operating strokes are not even and the on precision of the switch is hard to achieve.

SUMMARY OF THE INVENTION

It is therefore an object of the present invention to solve the above-described problem and to provide a water-resistant pilot switch in which the shape of a shield member is simple, processibility of parts and workability in mounting the parts to a housing are good, cost cutting is possible, and the on precision of the switch in action can be improved.

In order to solve the previously described problem, as a first solution, the water-resistant switching device according to the invention comprises: a housing having a receiving section, a fixed contact provided in the receiving section, a movable contact rotatably provided and being brought into or out of contact with the fixed contact, a lever member rotating the movable contact in the direction of the fixed contact, a cover member having an insertion hole through which one end of the lever member protrudes outwardly from the receiving section and being provided on the receiving section of the housing to be engaged therewith, and a shield member shielding the insertion hole; wherein the lever member is engaged with the insertion hole of the cover member in a rotatable manner, and the shield member is shaped like a ring to fit the rim of the insertion hole and is placed between the lever member and the cover member.

As a second solution, a rotation shaft rotatably supported in the insertion hole of the cover member is formed on the lever member and the ring-like shield member is engaged with the rotation shaft.

As a third solution, the lever member comprises a first lever portion disposed inside the receiving section of the housing and a second lever portion connected to the first lever portion and disposed outside the housing, the shield member being engaged with the rotation shaft of the first lever portion.

As a fourth solution, the first lever portion is rotated as a result of the rotation of the second lever portion, and an outer rim of the rotation shaft and an inner rim of the shield member are formed so as to slidably contact each other.

DESCRIPTION OF THE PREFERRED EMBODIMENT

Figure 1:
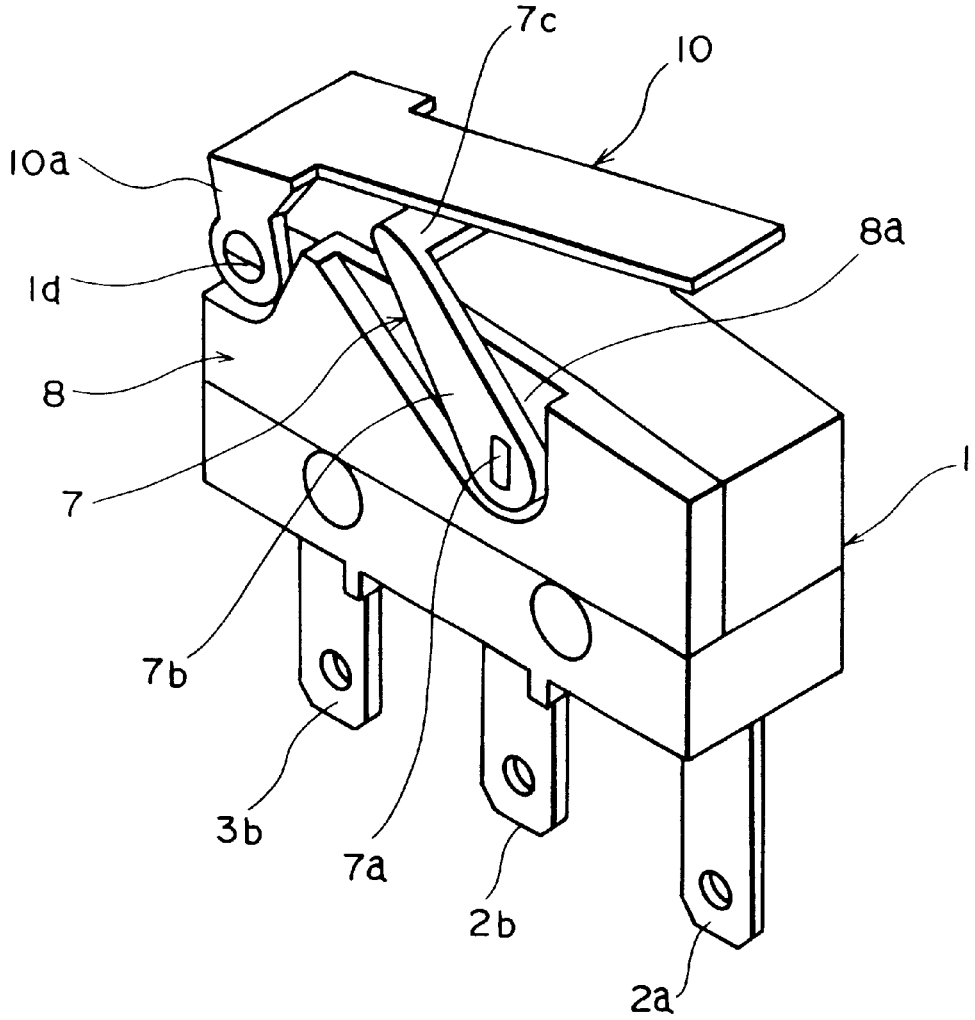
FIG. 1 is an overall perspective view showing a water-resistant pilot switch in accordance with an embodiment of the present invention.
Figure 2:
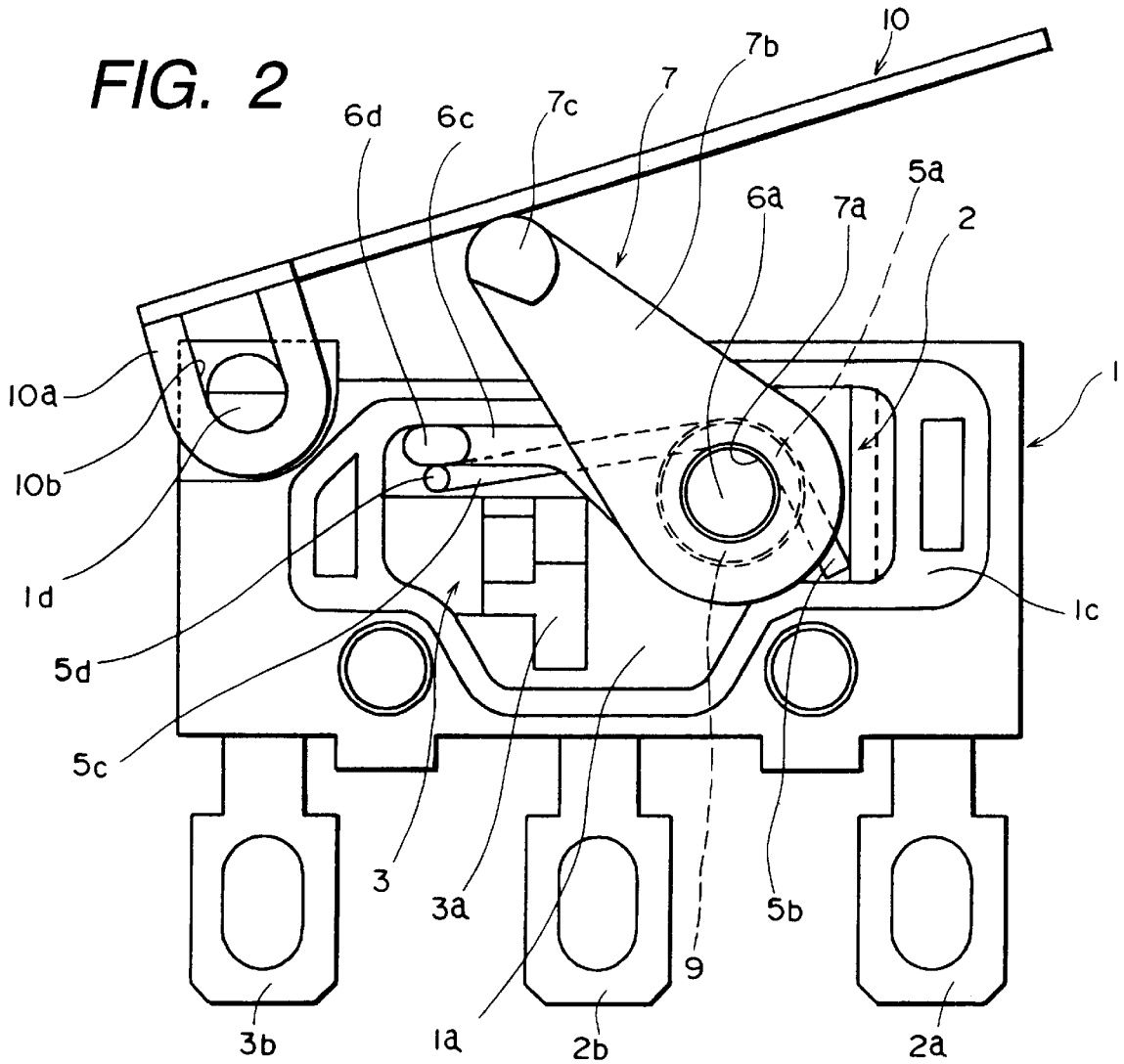
FIG. 2 is a plan view showing the water-resistant pilot switch while the cover member is removed therefrom.
Figure 3:
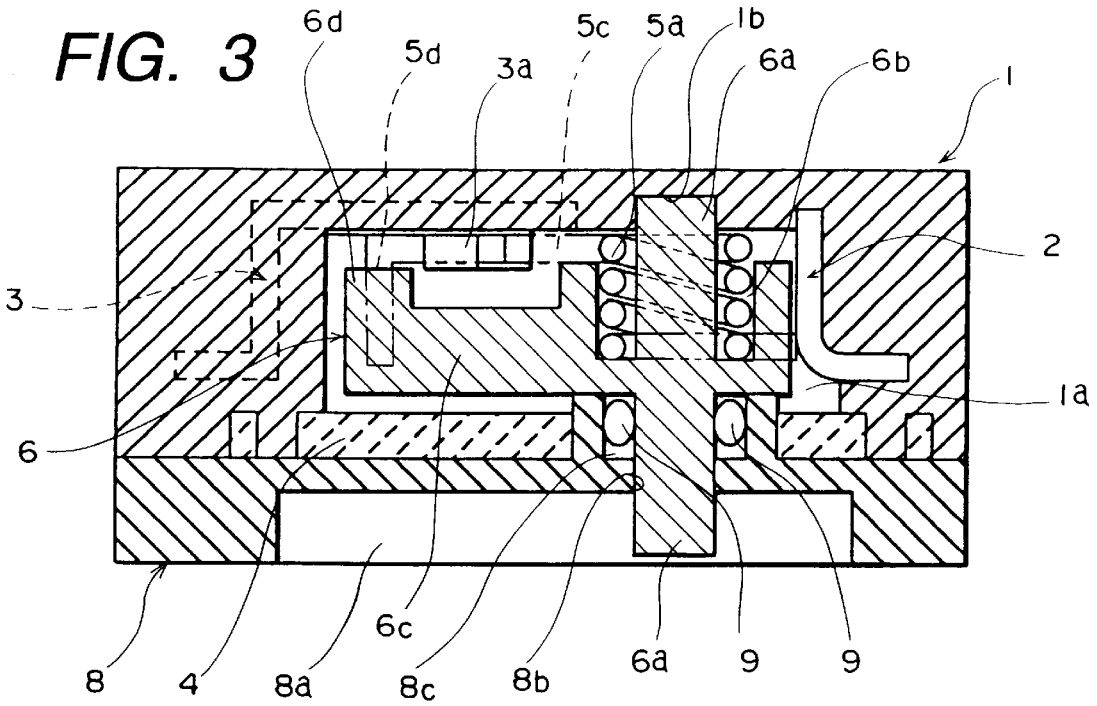
FIG. 3 is a transverse cross-section showing the water-resistant pilot switch while the second lever portion is removed therefrom.
Figure 4:
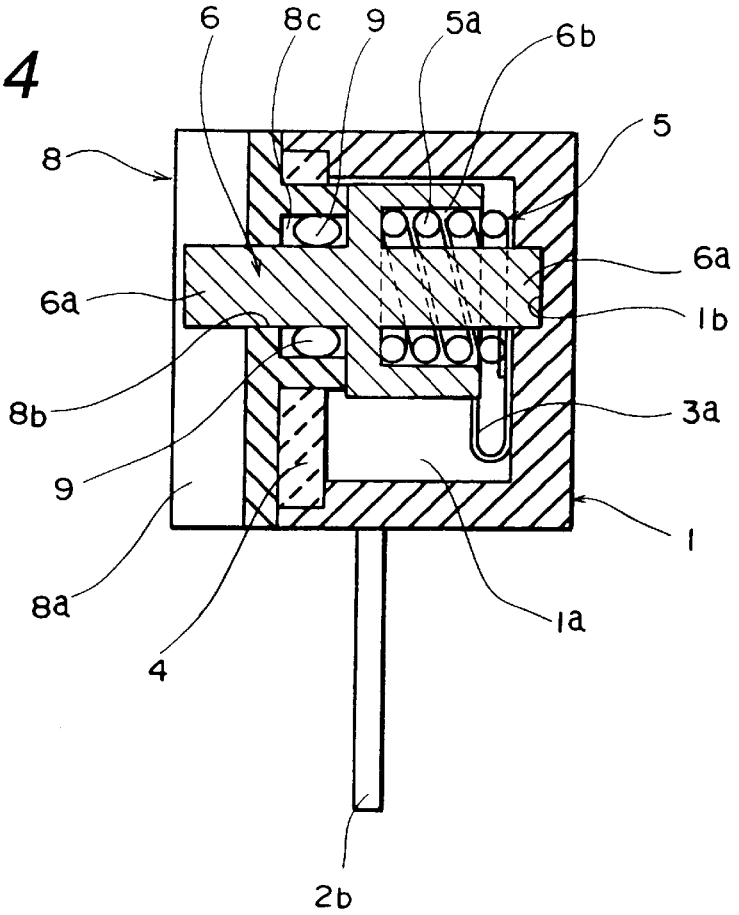
FIG. 4 is a vertical section showing the water-resistant pilot switch while the second lever portion is removed therefrom.
Figure 5:
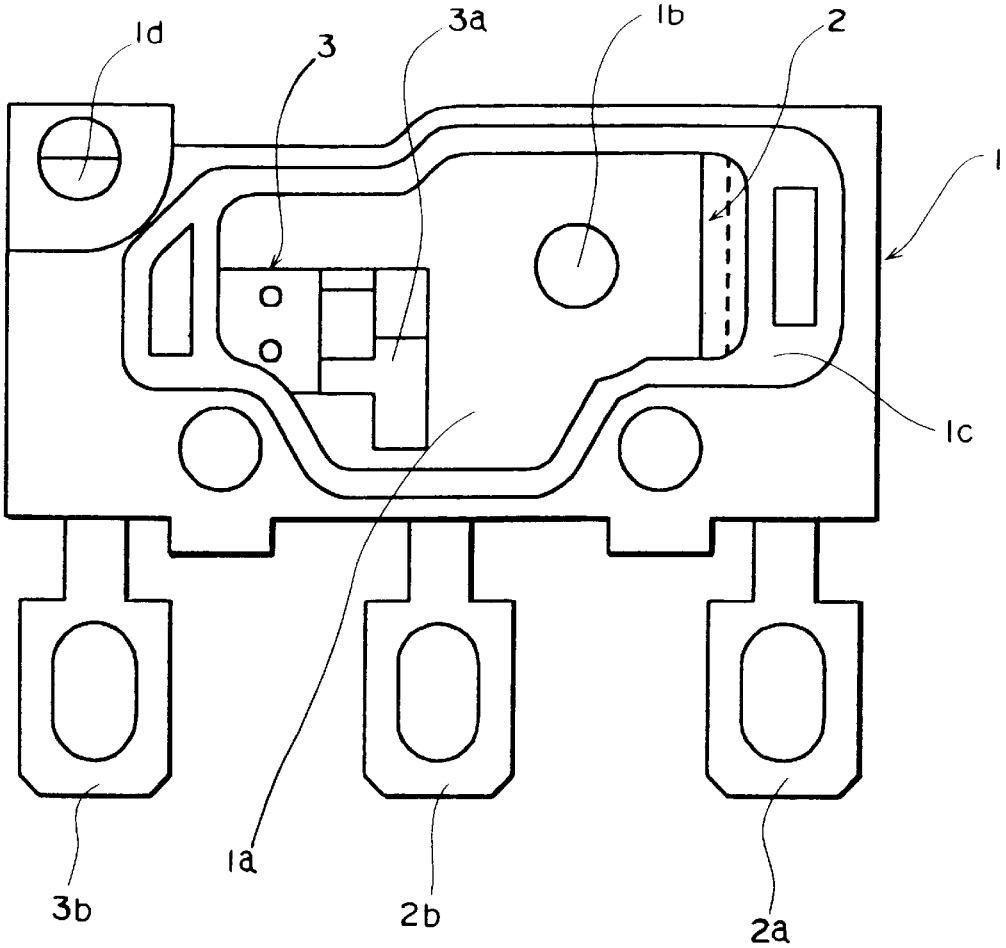
FIG. 5 is a plan view showing a housing of the water-resistant pilot switch.
Figure 6:
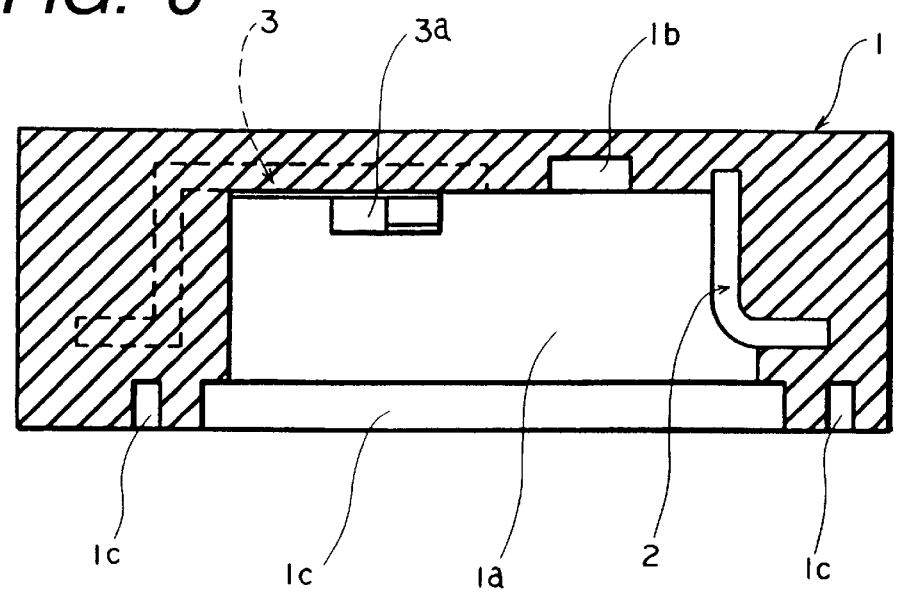
FIG. 6 is a transverse cross-section showing the housing of the water-resistant pilot switch.
Figure 7:
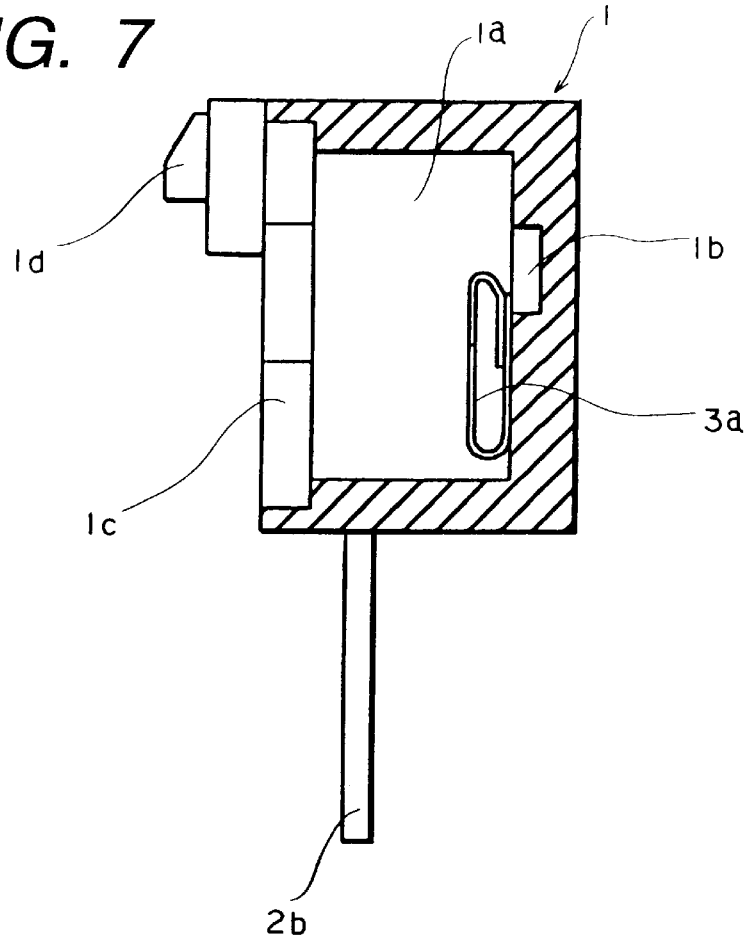
FIG. 7 is a vertical section showing the housing of the water-resistant pilot switch.
Figure 8:
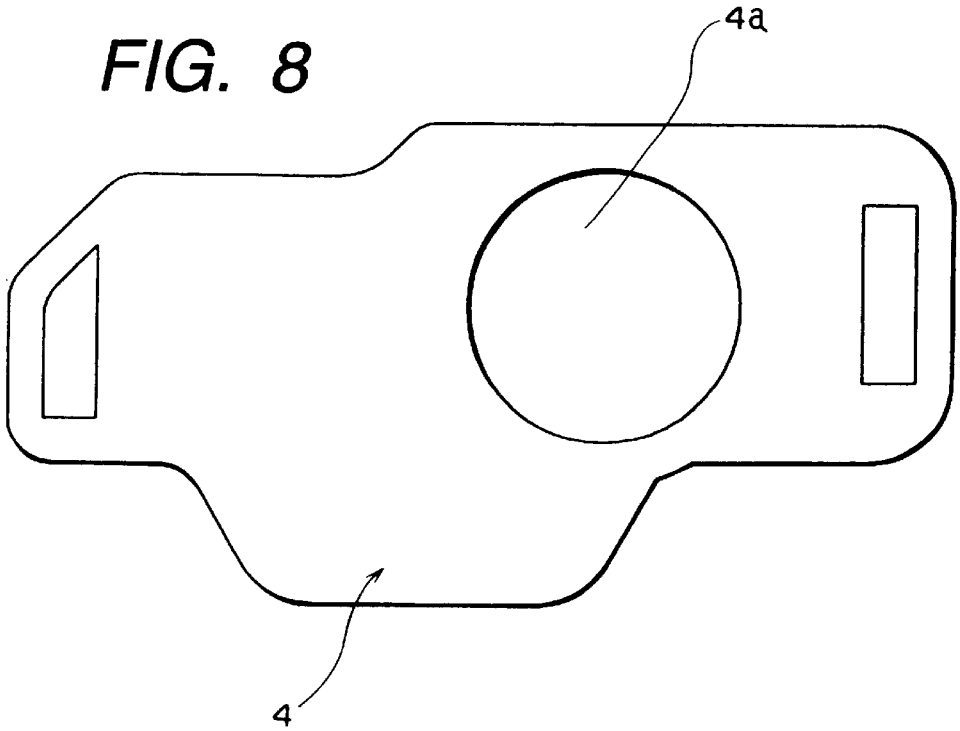
FIG. 8 is a plan view showing a rubber sheet of the water-resistant pilot switch.

Referring to FIGS. 1 to 8, an embodiment of the water-resistant pilot switch of the invention will be shown. FIG. 1 is an overall perspective view showing the water-resistant pilot switch; FIG. 2 is a plan view showing the water-resistant pilot switch while a cover member is removed therefrom; FIG. 3 is a transverse cross-section showing the water-resistant pilot switch while the second lever is removed therefrom; FIG. 4 is a vertical section of the same; FIG. 5 is a plan view showing a housing; FIG. 6 is a transverse cross-section of the same; FIG. 7 is a vertical section of the same; and FIG. 8 is a plan view of a rubber sheet.

In the drawings, the housing 1 is shaped like a box having a bottom and the side portion of the box is formed using an insulating material such as a synthetic resin so as to be opened. A receiving section 1*a* is formed inside the housing 1. On one side of an inner bottom portion of the receiving section 1*a*, a first fixed contact 2 made of conductive metal and formed in the shape of a plate is provided so as to be exposed outwardly. Also, the other end of the first fixed contact 2 is led out of the housing 1 and forms a first fixed terminal 2*a*. Further, a dummy fixed terminal 2*b* connected with the first fixed terminal 2*a* inside the housing 1 is provided externally and at the middle portion of the housing 1. Further, the dummy fixed terminal 2*b* is provided for facilitating wiring with external electronic devices and can be omitted if not necessary wiring-wise.

On one end, which is opposite to the side on which the first fixed contact 2 is disposed, of the inner bottom portion of the receiving section 1*a*, a second fixed contact 3 also made of conductive metal to be in the shape of a plate is spaced from the first fixed contact 2 while being exposed outwardly. A contacting piece 3*a*, which is also made up of a conductive metal sheet, is bent into the shape like a clip and can be resiliently deformed in the direction of supporting, is fixed to a tip end portion of the second fixed contact 3 to form one unit. Further, the other end of the second fixed contact 3 is led out of the housing 1 to form the second fixed terminal 3*b*.

At the middle portion of the receiving section 1*a*, a bearing recess 1*b* rotatably supporting a first lever portion 6, to be described later, is formed. Further, a groove 1*c* is formed in a periphery of an opening of the receiving section 1*a*, and a rubber sheet 4 for waterproofing supported between the groove 1*c* and a cover member 8, to be described later, is engaged with the groove 1*c*. This rubber sheet 4 is formed like a thin plate made of an elastic rubber, and a round hole 4*a* through which a rotation shaft 6*a* of a first lever member 6, to be described later, is inserted is formed at the center of the rubber sheet 4. By placing the rubber sheet 4 between the periphery of the opening of the housing 1 and the cover member 8, external water or droplets are prevented from entering.

Further, on one end of the outer side face of the housing 1, a pair of engagement protrusions 1*d* to rotatably engage with and latch an actuator 10, to be described later, are formed.

A coil spring 5 is made up of metal wiring rods, and it comprises a coil portion 5*a* around which the metal wiring rods are wound, a pressed contact 5*b* protruding from one end of the coil portion 5*a* and being pressed by the first fixed contact 2, a movable contact 5*c* shaped like an arm extending from the other end on the opposite side of the pressed contact 5*b*, and a bent portion 5*d* provided at the tip end of the movable contact 5*c* in a bent manner. This coil spring 5 has a function of a return spring to urge the first lever portion 6, to be described later, in the returning direction, and a function of a movable contact being disposed between the first and second fixed contact 2, 3 and connecting the two contacts to provide conductivity between them.

The first lever portion 6 is made of an insulating material such as synthetic resin and has a rotation shaft 6*a*, at the center, protruding to both sides. In one periphery of the rotation shaft 6*a*, a retaining recess 6*b* is formed to retain the coil portion 5*a* of the coil spring 5 through which the rotation shaft 6*a* is inserted. Further, there is an extending arm 6*c* extending from the middle portion where the rotation shaft 6*a* is formed to one end portion. On a tip end of the extending arm 6*c*, a driving portion 6*d* contacting with the bent portion 5*d* of the coil spring 5 and bringing the movable contact 5*c* into or out of contact with the contacting piece 3*a* provided on the second fixed contact 3.

The second lever portion 7 is also made of an insulating material such as synthetic resin and is substantially L-shaped. In the center thereof, an engagement hole 7 *a* to engage with one end of the rotation shaft 6 *a* of the first lever portion 6 is provided. On the tip end side of an operating rod 7*b* attached in an extending manner in an L shape from the center, a slidably contacting arm 7*c* with which an actuator 10, to be described later, slidably contacts is formed.

Since the first lever portion 6 and the second lever portion 7 are formed separately to be engageable, it is sufficient to provide one type of the first lever portion 6, which leads up to a commonality of components. Further, by simply changing the second lever portion 7, it becomes possible to comply with various kinds of operations.

The cover member 8 is made from an insulating material such as synthetic resin to be in the shape of a flat plate. In the middle portion of the outer surface thereof, a V-shaped rotation groove 8*a* in which the operating rod 7*b* of the second lever portion 7 rotates is provided. Further, in the lower center of the rotation groove 8*a*, an insertion hole 8*b* through which one end side of the rotation shaft 6 *a* of the first lever portion 6 is inserted and extended outwardly is formed. On the inner side face of the insertion hole 8*b*, a round recess 8*c* is formed along a rim of the insertion hole 8*b*, and a shield member 9, to be described later, is provided therein to engage with the round recess 8*c*.

The shield member 9 is made of elastic rubber, etc. to be formed like a ring. The shield member 9 is further inserted into a base portion of one end side of the rotation shaft 6*a* of the first lever portion 6, and is latched there while closely contacting the outer rim of the rotating shaft 6*a*.

In this state, when the rotation shaft 6 *a* of the first lever portion 6 is inserted into the insertion hole 8*b* of the cover member 8, the shield member 9 is supported between the outer rim of the rotation shaft 6 *a* and the inner rim of the round recess 8*c* provided along the periphery of the insertion hole 8*b* and latched there.

Thus, the shield member 9 is shaped like a ring being closely attached along the outer rim of the rotation shaft 6*a*. Therefore, even when the rotation shaft 6 *a* is rotated, since the shield member 9 is closely engaged and latched with the inner rim of the round recess 8*c* of the insertion hole 8*b* and the outer rim of the rotating shaft 6*a*, water and droplets via the insertion hole 8*b* can be prevented from entering.

At this time, since the outer rim of the rotation shaft 6*a* and the inner periphery of the shield member 9 are formed to be engaged with each other in a sliding manner, the first lever portion 6 can be rotated smoothly. On the contrary, however, the outer periphery of the shield member 9 and the inner rim of the round recess 8*c* of the insertion hole 8*b* may be formed so as to contact each other in a sliding manner.

The actuator 10 is made up of a material such as metal plate to be formed into the shape of a plate. On one side thereof, a supporting piece 10*a* bent in an opposing manner is formed, and on the supporting piece 10*a*, an engagement hole 10*b* to be engaged with the engagement protrusion 1*d* provided in the housing 1 is formed. Thus, the engagement hole 10*b* is engaged with the engagement protrusion 1*d* so that the actuator 10 is mounted to the housing 1 in a rotatable manner.

The operation in the above embodiment will now be described.

In an initial state, the first fixed contact 2 and the second fixed contact 3 are in an off condition. When the actuator 10 is pressed by an external operating device, etc., the slidably contacting arm 7*c* of the second lever portion 7 contacting the actuator 10 is pressed to rotate in a counterclockwise direction. In accordance with the rotation of the second lever portion 7, the connected first lever portion 6 is also rotated in a counterclockwise direction. Accordingly, the driving portion 6*d* on the tip end side of the extending arm 6*c* extended on one end of the first lever member 6 presses down the bent portion 5*d* of the coil spring 5.

At this moment, the movable contact 5*c* provided on the coil spring 5 is rotated in a counterclockwise direction or in the direction of the contacting piece 3*a* provided on the second fixed contact 3. Being held by the clip-like contacting piece 3*a*,the first fixed contact 2 and the second fixed contact 3 are connected through the coil spring 5 and a switch circuit is turned on.

In this case, the pressed contact 5*b* protruded on one end side of the coiled portion 5*a* is pressed by the first fixed contact 2 as a result of a force produced at the coiled portion 5*a*. Further, since the movable contact 5*c* is supported from both sides by the clip-like contacting piece 3*a*,the first fixed contact 2 and the second fixed contact 3 are securely connected through the coil spring 5.

In this state, when the pressing force of the actuator 10 is released, the first and second lever portions 6, 7 are rotated in a clockwise direction by the urging force in the returning direction of the coil spring 5 and returned to the initial position. At this moment, the movable contact 5*c* provided on the coil spring 5 leaves the clip-like contacting piece 3*a*, bringing the switch circuit into an off condition.

According to the above-described embodiment of the present invention, the ring-like shield member 9 made of elastic rubber is placed and held between the rotation shaft 6*a* of the first lever portion 6 provided in the receiving section 1*a* of the housing 1 and the insertion hole 8*b* of the cover member 8 from which the rotation shaft 6*a* protrudes. As a result, it becomes unnecessary to form the shield member 9 in accordance with the shape of the operating parts such as the second lever portion 7. Thus, since its shape is simple, the mounting of the shield member 9 to the housing 1 and the cover member 8 is simple and easy, processibility of parts and workability in assembly can be improved, thereby resulting in cost cutting.

Further, the shield member 9 made of elastic rubber, etc. is not placed in a portion to abut against the actuator 10 rotating the first and second lever portions 6, 7, thereby enabling a directly pressing mechanism. Thus, uneven operational strokes caused by deflection of rubber, etc. can be avoided, and the on precision of the switch is improved.

As described above, the water-resistant pilot switch according to the present invention comprises an insertion hole through which one end of the lever member disposed in the receiving section of the housing is protruded outwardly from the receiving section, a cover member provided on the receiving section of the housing to be engaged therewith, and a shield member shielding the insertion hole. The lever member is rotatably engaged with the insertion hole of the cover member. Further, the shield member is shaped like a ring to fit the rim of the insertion hole and is placed between the lever member and the cover member. Thus, it becomes unnecessary to form the shield member in accordance with the shape of operating parts such as the lever member. Since its shape is simple, the mounting of the shield member to the housing and the cover member is easy and simple, which improves processibility of parts and assembling workability, resulting in cost cutting.

Further, a rotation shaft rotatably supported in the insertion hole of the cover member is formed on the lever member, and the ring-like shield member is engaged with the rotation shaft. With such a simple construction, since the shield member is closely engaged and latched with the inner rim of the insertion hole and the outer rim of the rotation shaft, even when the rotation shaft is rotated, water and droplets can be prevented from entering through the insertion hole.

The lever member comprises a first lever portion disposed inside the receiving section of the housing, and a second lever portion connected to the first lever portion and disposed outside the housing. Further, the shield member is engaged with the rotation shaft of the first lever portion. Thus, the commonality of components can be achieved and, at the same time, it becomes possible to comply with various kinds of operations simply by changing the second lever portion.

Further, in the construction according to the present invention, the first lever portion rotates as a result of the rotation of the second lever portion, and the outer rim of the rotation shaft and the inner rim of the shield member contact each other in a sliding manner, enabling a smooth rotary operation of each lever portion.

What is claimed is:

1. A water-resistant switching device, comprising:

a housing having a receiving section, a fixed contact provided in the receiving section, a movable contact rotatably provided and being brought into or out of contact with the fixed contact, a lever member rotating the movable contact in a direction of the fixed contact, a cover member having an insertion hole through which one end of the lever member protrudes outwardly from the receiving section and being provided on the receiving section of the housing to be engaged therewith, and a shield member shielding the insertion hole;

wherein the lever member is engaged with the insertion hole of the cover member in a rotatable manner, and the shield member is shaped like a ring to fit a rim of the insertion hole and is placed between the lever member and the cover member.

2. A water-resistant switching device according to claim 1, wherein a rotation shaft rotatably supported in the insertion hole of the cover member is formed on the lever member and the ring-like shield member is engaged with the rotation shaft.

3. A water-resistant switching device according to claim 2, wherein the lever member comprises a first lever portion disposed inside the receiving section of the housing and a second lever portion connected to the first lever portion and disposed outside the housing, the shield member being engaged with the rotation shaft of the first lever portion.

4. A water-resistant switching device according to claim 3, wherein the first lever portion is rotated as a result of the rotation of the second lever portion, and an outer rim of the rotation shaft and an inner rim of the shield member are formed so as to slidably contact each other.

* * * * *